US005686878A

United States Patent [19]

Gueli

[11] Patent Number: 5,686,878

[45] Date of Patent: Nov. 11, 1997

[54] TEMPERATURE SENSITIVE FUSIBLE LINK ASSEMBLY HAVING COOPERATING PROJECTIONS AND SLOTS

[76] Inventor: Carmen Gueli, 3760 Dale, Saginaw, Mich. 48603

[21] Appl. No.: 415,323

[22] Filed: Apr. 3, 1995

[51] Int. Cl.[6] ..... H01H 37/76

[52] U.S. Cl. ..... 337/416; 337/411; 337/407

[58] Field of Search ..... 337/114, 150, 337/227–234, 238, 240, 407, 411–416; 403/28, 2, 179, 270; 169/26, 38, 39, 42

[56] References Cited

U.S. PATENT DOCUMENTS

| | | | |
|---|---|---|---|
| 1,248,433 | 11/1917 | Lewis | 169/42 |
| 3,348,617 | 10/1967 | Macartney | 169/42 |
| 3,613,795 | 10/1971 | Amicone et al. | 169/42 |
| 3,779,004 | 12/1973 | Gloeckler | 59/93 |
| 3,866,686 | 2/1975 | Goodsell, Jr. et al. | 169/39 |
| 4,055,829 | 10/1977 | Ruegsegger | 337/416 |
| 4,103,272 | 7/1978 | Larsen | 337/411 |
| 4,343,364 | 8/1982 | Glinecke | 169/38 |
| 4,346,554 | 8/1982 | Glinecke | 59/93 |
| 4,527,635 | 7/1985 | Kirchner | 169/26 |
| 4,532,681 | 8/1985 | Baker et al. | 403/28 |
| 4,596,483 | 6/1986 | Gabriel | 403/28 |
| 4,738,314 | 4/1988 | Lee | 169/42 |
| 5,120,152 | 6/1992 | Gueli | 403/179 |

FOREIGN PATENT DOCUMENTS

| | | |
|---|---|---|
| 803862 | 11/1958 | United Kingdom . |
| 903699 | 8/1962 | United Kingdom . |

*Primary Examiner*—Leo P. Picard
*Assistant Examiner*—Jayprakash N. Gandhi
*Attorney, Agent, or Firm*—Bliss McGlynn, P.C.

[57] ABSTRACT

A fusible link assembly including a pair of link members arranged in overlying relation and a thermally sensitive bonding material interposed between the link members with the bonding material being solid below a predetermined temperature to form a bond between the link members and liquid at and above the predetermined temperatures such that the link member separates. Each of the link members includes a projection and a slot corresponding to the projection. The slot is spaced relative to the projection on the link member such that the projection of one of the link members is received in the slot of the other link member. Each of the link members also includes an opening with each opening on each of the link members being aligned to define a passage through the fusible link.

18 Claims, 2 Drawing Sheets

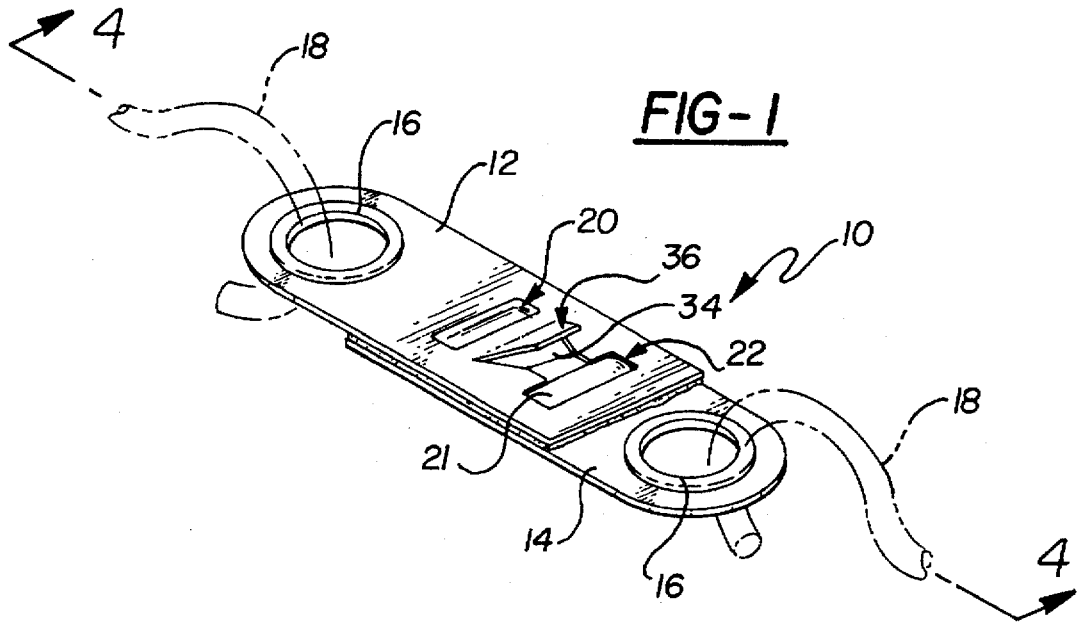
FIG-1
FIG-2
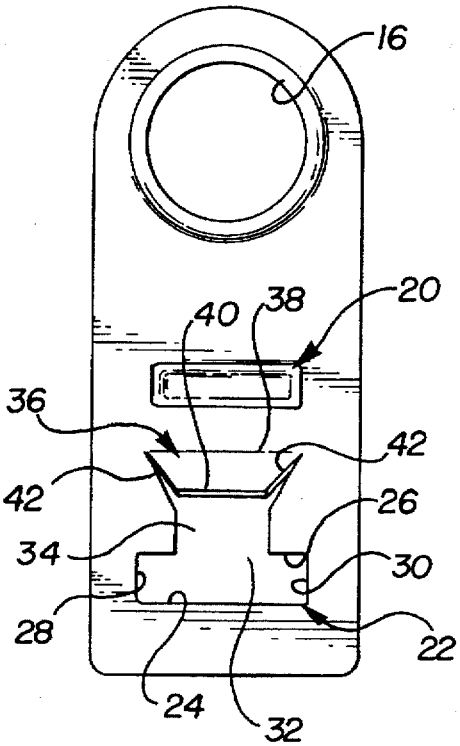
FIG-3
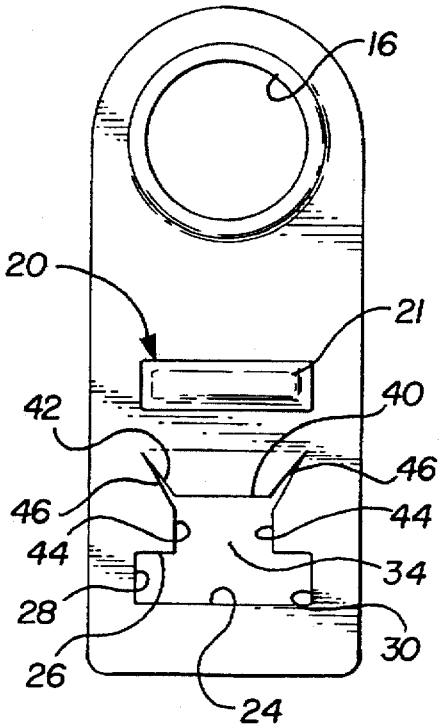

TEMPERATURE SENSITIVE FUSIBLE LINK ASSEMBLY HAVING COOPERATING PROJECTIONS AND SLOTS

BACKGROUND OF THE INVENTION

1. Technical Field

The subject invention relates to fusible links, and in particular, to fusible links which resist creep but which respond quickly when subjected to temperatures above a predetermined temperature.

2. Description of the Related Art

Fusible link constructions have been used for releasing locking mechanisms, closing fire doors, releasing sprinkler operating levers, and the like. Typically, such mechanisms have a weight or spring biassed actuator maintained in a non-operating position against the bias of the weight or spring by means of the fusible link. In response to an increase to a predetermined level of the ambient temperature, the members of the link which are joined by a bonding material separate which enables the bias imposed on the operator to move the latter from its non-operating position to its operating position.

Various kinds of fusible links have been proposed in the past. One of the most common fusible links employed in the prior art comprises a pair of flat plates arranged side-by-side and separably bonded to one another by a thermally sensitive substance which liquifies when its temperature is raised to a predetermined level, thereby destroying the bond between the plates and permitting them to separate.

One of the disadvantages of this type of construction is that the juxtaposed plates tend to creep over a period of time when subjected to a tensile or compressive load. In time, the bonding material may creep to an extent that is incapable of maintaining the plates in a joined condition or causes shortening or elongating of the assembly to the point that proper operation of the mechanism whose operation is to be controlled cannot be ensured. Alternatively, creep can manifest itself to allow slippage to occur between the fused parts rather than a clean separation. Specifically and at the eutectic temperature, instead of fully releasing, the fused parts may tend to move longitudinally without a clean break. In both instances, this is a malfunctioning of the fuse.

Attempts have been made in the prior art to address this problem by utilizing multiple components and/or interlocking members in an effort to strengthen the link and limit the effects of creep. For example, one type of fusible link assembly designed to prevent creep over time is disclosed in U.S. Pat. No. 5,120,152 issued to Gueli on Jan. 9, 1992. The Gueli '152 patent discloses a fusible link including top and bottom members which are juxtaposed in side-by-side relation and bonded together by a thermally sensitive eutectic material. The first member includes a quadrangular projection which is received in a complementary quadrangular slot of the second member. Each of the members include pins which present a gap when both members are disposed in side-by-side relationship. This gap is filled by the eutectic alloy. The cooperation of the projection and slot is designed to prevent creep.

Similarly, U.S. Pat. No. 4,055,829 issued to Ruegsegger on Oct. 25, 1977 discloses a fusible link including a pair of members which are disposed in side-by-side relationship relative to one another and bonded together using a eutectic alloy. The first member includes triangular shaped camming surfaces which coact with confronting camming surfaces on the opposite member to inhibit the effects of creep.

While the fusible links of the prior art gain strength and eliminate malfunctions caused by creep, they also sacrifice response time when subjected to elevated ambient temperature conditions due to fire or other heat sources. Further and in some cases, the interlocking portions of the fusible links can prevent separation of the members of the link even after liquidation of the bonding material. Accordingly, there is a need in the art for a fusible link which properly resists the unwanted affects of creep but yet may quickly respond to elevated ambient temperatures above a predetermined temperature.

SUMMARY OF THE INVENTION

The subject invention overcomes the problems of creep in the prior art while providing very fast response to fire conditions. More specifically, the subject invention is directed toward a fusible link assembly including a pair of link members arranged in overlying relation with each link member opposed diametrically with respect to the other and a thermally sensitive bonding material interposed between the link members. The bonding material is solid below a predetermined temperature to form a bond between the link members and is liquid at and above the predetermined temperature such that the link members separate. Each of the link members include a projection and a slot corresponding to the projection. The slot is spaced relative to the projection on the link members such that the projection on one of the link members is received in nesting relation in the slot of the other of the link members and such that the cooperation of the projection and the slot inhibits creep between the pair of link members. Furthermore, each of the link members include an opening with each opening of each link member being aligned to define a passage through the fusible link. This passage promotes air flow through the fusible link thereby improving heat transfer between the ambient air and the fusible link to increase responsiveness of the fusible link to ambient temperatures above the predetermined temperature without creep between the pair of link members.

In this way, the subject invention overcomes the problems of the prior art by eliminating the malfunctions of creep and, at the same time, increasing the responsiveness of the fusible link to ambient temperatures above a predetermined temperature.

BRIEF DESCRIPTION OF THE DRAWINGS

Other features and advantages of the present invention will be readily appreciated as the same becomes better understood after reading the subsequent description when considered in connection with the accompanying drawings wherein:

FIG. 1 is a perspective view of the fusible link of the subject invention in an operative environment;

FIG. 2 is a top plan view of a link member of the subject invention;

FIG. 3 is a bottom plan view of the link member of the subject invention;

DESCRIPTION OF THE PREFERRED EMBODIMENT(S)

A fusible link assembly constructed in accordance with the invention is generally indicated at 10 in FIG. 1. The fusible link 10 is typically employed in a fire detection and suppression system, for example, in the hood or vent of a commercial stove or oven in a restaurant. However, it should be appreciated that the fusible link may be employed in many different applications. The fusible link 10 includes a pair of link members 12, 14 arranged in overlying relation with each link member 12, 14 opposed diametrically with respect to the other. The link members 12, 14 are constructed from sheet metal stock from which the links are progressively formed by cutting, piercing, flanging, parting and ultimately sheering the finished part from the stock.

Figure 4:
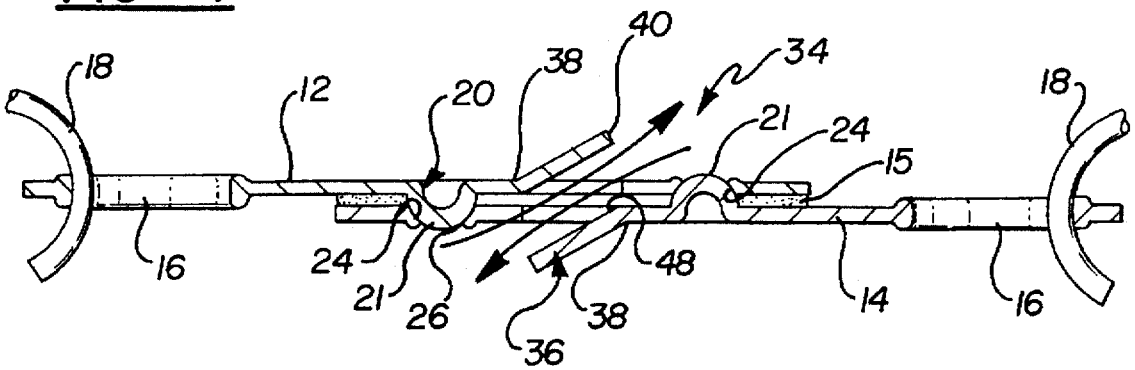
FIG. 4 is a cross-sectional side view of the fusible link of the subject invention.

A thermally sensitive bonding material such as an eutectic alloy 15 is interposed between the link members as shown in FIG. 4. The bonding material 15 is solid below a predetermined temperature to form a bond between the link members 12, 14. When the ambient temperature increases to predetermined level, such as 135° F., the bonding material 15 will liquify allowing the members 12 and 14 to separate. In the preferred embodiment, each of the link members 12, 14 is identical to the other. Accordingly, the structure described with respect to one link applies also to the other. The use of identical link members 12, 14 reduces manufacturing costs and ensures that the fusible link 10 is assembled in only one way. However, it should be understood that the identity of the link members 12, 14 is not essential to the subject invention.

Each of the link members 12, 14 include an aperture 16 at one end thereof which, when combined to form the fusible link 10, accommodates another element in a fire detection and suppression system such as hook 18. In this configuration, the link 10 is placed in tension and will separate to trigger an alarm, fire suppression system, etc. when the ambient temperature exceeds the predetermined level and liquifies the bonding material 15.

Figure 5:
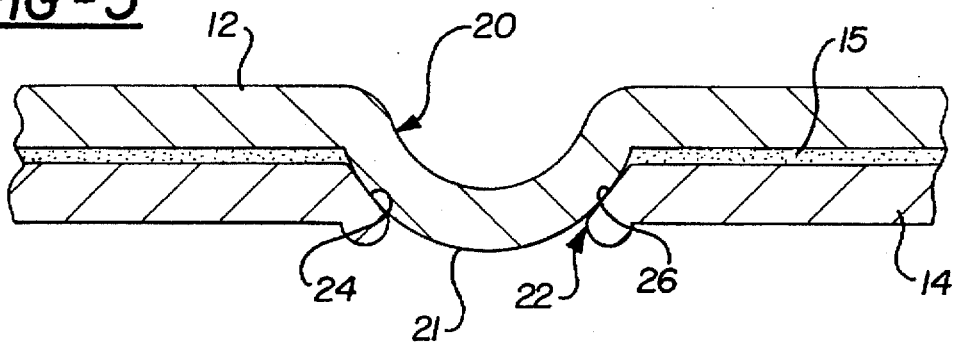
FIG. 5 is a partial cross-sectional side view of the fusible link of the subject invention illustrating the interaction of the projection with the slot.
Figure 6:
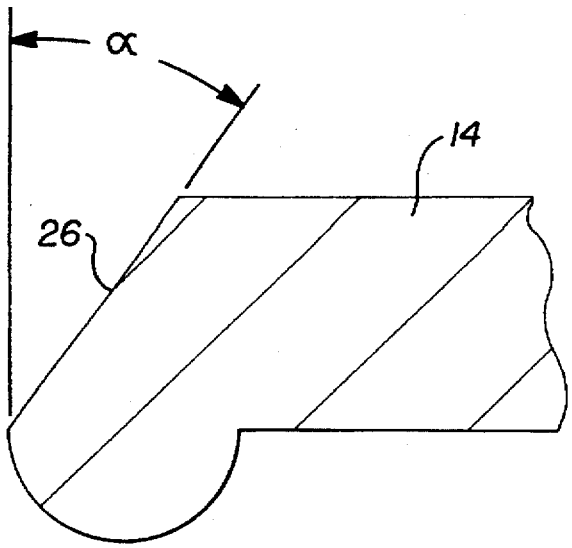
FIG. 6 is a partial cross-sectional side view of one flat edge of the slot in the link members.

Each of the link members 12, 14 include a projection, generally indicated at 20 and a slot, generally indicated at 22 which corresponds to the projection 20. The projection 20 is rectangular in plan as shown in FIGS. 2 and 3 and presents an arcuate outer surface 21 as shown in FIG. 5. The slot 22 is spaced relative to the projection 20 on the link members 12, 14 such that the projection 20 on one of the link members is received in nesting relation in the slot 22 of the other link member. Similarly, the slot 22 is substantially rectangular in plan and presents at least one flat edge 24, 26. More specifically, the slot has a pair of longer sides 24, 26 and a pair of shorter sides 28, 30 as shown in FIGS. 2 and 3. Each slot 22 also has a gap 32 on one 26 of its longer sides.

Alternatively, and in the case where the link members are not identical, one of the link members may include the projection 20 and the other of the link members may include the slot 22 which corresponds to the projection such that the projection of the one link member is received in nesting relation in the slot of the other link member.

The cooperation of the projection 20 and the slot 22 inhibits creep between the pair of link members 12, 14. More specifically, the projection 20 of the link member 12 is received in nesting relation in the slot 22 of the other link member 14 such that the arcuate outer surface 21 of the projection 20 engages the flat edges 24, 26 of the slot 22 and such that cooperation of the projection 20 and slot 22 inhibits creep between the pair of link members 12, 14. The flat edges 24, 26 presented by the slot 22 are contained in a plane disposed at an angle $\alpha$ relative to the vertical. In the preferred embodiment, the flat edge 24, 26 is contained within a plane disposed at an angle $\alpha$ of approximately 35° relative to the vertical. This inclined plane is an angle of friction which limits the direct force on the eutectic alloy 15, the bonding and release agent. This incline plane of flat edges 24, 26 increases the load characteristics of the fusible link 10. It also retards the release time of the device. The arcuate outer surface 21 of the projection 20 helps to overcome the delay in release time. Its radiused surface limits the amount of surface area that is in contact with the flat edges 24, 26 where the two surfaces 21 and 24 or 26 slide against one another. This results in less work being expended in friction and, hence, better efficiency and faster operation of the link 10. Additionally, the arcuate outer surface 21 of the projection 20 provides clearance between the two link members 12, 14. This clearance is filled by the eutectic alloy 15. When the fused link 10 reaches operating temperatures, the alloy 15 in the clearance acts as a partial or incomplete lubricant and the load on the opposed link members 12, 14 is carried partly by the melted alloy thereby reducing the coefficient of friction on these surfaces.

The interaction of the arcuate outer surface 21 with the flat inclined edges 24, 26 of the slot 22 is especially important at higher temperatures, such as over 400° F. In the event of a fire, the rate of temperature rise increases dramatically and if a fusible link operates slowly at higher temperatures, the metallic link members can become softer and have a tendency to bond together rather than to separate. The relationship between the arcuate outer or radiused surface 21 of the projection 20 with the inclined edges 24, 26 of the slot 22 provide improved strength and yet fast operation of the fusible link 10.

Each of the link members 12, 14 includes an opening 34 which is disposed between the projection 20 and the slot 22. Furthermore, each opening 34 on each of the link members 12, 14 is aligned relative to the other to define a passage through the fusible link 10 as generally indicated with the arrows in FIG. 4. The passage promotes air flow through the fusible link 10 thereby improving heat transfer between the ambient air and the fusible link 10. This increases the responsiveness of the fusion link to the ambient temperatures above the predetermined temperature without creep between the pair of link members 12, 14.

Each of the link members 12, 14 also include a tab, generally indicated at 36, extending at an acute angle relative to its corresponding link member 12, 14 and joined at its base 38 to the link members 12, 14 adjacent the projection 20. As best shown in FIG. 4, tabs 36 extend opposite one another and are disposed in spaced parallel relation relative to each other when the link members 12, 14 are arranged in overlying relation relative to one another to channel ambient air through the passage. The tabs 36 define a truncated triangular shape with a top edge 40 and a pair of sides 42 diverging from the top edge 40 and terminating at the base 38 of the tabs 36 adjacent the projections 20 as best shown in FIGS. 2 and 3.

When assembled to form the fusible link 10, each of the openings 34 in the link members 12, 14 is bounded on one edge by the projection 20 of the link member cooperating with the slot 22 to fill the gap 32 on the one side 26 thereof. Each opening 34 also includes a pair of edges 44 in spaced parallel relation relative to each other. Each of the parallel edges 44 merge into diverging sides 46 corresponding to the diverging sides 42 of the tab 36. The opening 34 is bounded on an edge 48 opposite the one edge formed by the projection 20 filling the gap 32 by the underside of the base 38 of the tab 36. The openings 34 as well as the tabs 36 are formed by piercing the sheet metal stock of the link members 12, 14.

In its operative mode, the projection 20 and slot 22 of the fusible link 10 cooperate to prevent creep often associated with the prior art structure. However, the increased strength of the fusible link 10 of the subject invention does not degrade response time to elevated ambient temperatures due to the aligned openings 34 in each of the link members 12, 14. These aligned openings 34 create improved heat transfer from the ambient air to the fusible link causing faster melting of the eutectic alloy of the boding material 15. In this way, the strength of the fusible link 10 and its resistance to creep is achieved without sacrifice of response time to elevated temperatures.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A fusible link assembly comprising:

a pair of link members arranged in overlying relation with each link member opposed diametrically with respect to the other and a thermally sensitive bonding material interposed between said link members, said bonding material being solid below a predetermined temperature to form a bond between said link members and liquid at and above said predetermined temperature such that said link members separate;

each of said link members including a projection and a slot corresponding to said projection, said slot spaced relative to said projection on said link members such that the projection on one of said link members is received in nesting relation in the slot of the other said link members and such that the cooperation of said projection and slot inhibits creep between said pair of link members; and each of said link members including an opening located between said projection and said slot with each opening on each of said link members being aligned to define a passage through said fusible link and to promote air flow through said fusible link thereby improving heat transfer between the ambient air and said fusible link to increase the responsiveness of said fusible link to ambient temperatures above said predetermined temperature without creep between said pair of link members.

2. An assembly as set forth in claim 1 wherein each of said link members includes a tab extending at an acute angle relative to its corresponding link member and joined at its base to said link member adjacent said projection, said tabs extending opposite one another and disposed in spaced parallel relation relative to each other when said link members are arranged in overlying relation relative to one another to channel ambient air through said passage.

3. An assembly as set forth in claim 2 wherein each of said tabs define a truncated triangular shape with a top edge and a pair of sides diverging from said top edge and terminating at said base of said tab adjacent said projection.

4. An assembly as set forth in claim 3 wherein each of said openings in said link members is bounded on one edge by said projection of the other link member cooperating with said slot and having a pair of edges in spaced parallel relation relative to each other, each of said parallel edges merging into diverging sides corresponding to said diverging sides of said tab, said opening bounded on an edge opposite said one edge by said base of said tab.

5. Art assembly as set forth in claim 4 wherein said projection is rectangular in plan.

6. An assembly as set forth in claim 5 herein said slot is substantially rectangular in plan but having a gap on one of its longer sides, said gap being filled by said projection to define one edge of said opening.

7. An assembly as set forth in claim 6 wherein each of said link members is identical to the other and includes an aperture at one end adapted to accommodate another element in a fire detection apparatus to place the fusible link in tension.

8. A fusible link assembly comprising:

a pair of link members arranged in overlying relation and a thermally sensitive bonding material interposed between said link members, said bonding material being solid below a predetermined temperature to form a bond between said link members and liquid at and above said predetermined temperature such that said link members separate;

one of said link members including a projection and the other of said link members including a slot corresponding to said projection such that the projection of the one link member is received in nesting relation in the slot of the other link member and such that the cooperation of said projection and slot inhibits creep between said pair of link members; and each of said link members including an opening located between said projection and said slot with each opening on each of said link members being aligned to define a passage through said fusible link and to promote air flow through said fusible link thereby improving heat transfer between the ambient air and said fusible link to increase the responsiveness of said fusible link to ambient temperatures above said predetermined temperature without creep between said pair of link members.

9. An assembly as set forth in claim 8 wherein each of said link members includes a tab extending at an acute angle relative to its corresponding link member and joined at its base to said link member adjacent said projection, said tabs extending opposite one another and disposed in spaced parallel relation relative to each other when said link members are arranged in overlying relation relative to one another to channel ambient air through said passage.

10. An assembly as set forth in claim 9 wherein each of said tabs define a truncated triangular shape with a top edge and a pair of sides diverging from said top edge and terminating at said base of said tab adjacent said projection.

11. An assembly as set forth in claim 10 wherein said projection is rectangular in plan.

12. A fusible link assembly comprising:

a pair of link members arranged in overlying relation and a thermally sensitive bonding material interposed between said link members, said bonding material being solid below a predetermined temperature to form a bond between said link members and liquid at and above said predetermined temperature such that said link members separate;

one of said link members including a projection, said projection presenting an arcuate outer surface, the other of said link members including a slot corresponding to said projection and presenting at least one flat edge inclined at a predetermined angle $\alpha$, said projection of said link member received in nesting relation in said slot of the other link member such that said arcuate outer surface of said projection engages said inclined flat edge of said slot and such that cooperation of said projection and said slot inhibits creep between said pair of link members.

13. A fusible link assembly as set forth in claim 12 wherein said at least one flat edge is contained within a plane inclined at an angle $\alpha$ of approximately 35°.

14. A fusible link assembly as set forth in claim 12 wherein said slot presents a pair of flat edges disposed opposite one another such that said arcuate outer surface of said projection engages said pair of flat edges of said slot.

15. A fusible link assembly as set forth in claim 12 wherein each of said link members includes an opening with each opening on each of said link members being aligned to define a passage through said fusible link and to promote air flow through said fusible link thereby improving heat transfer between the ambient air and said fusible link to increase the responsiveness of said fusible link to ambient temperatures above said predetermined temperature without creep between said pair of link members.

16. An assembly as set forth in claim 15 wherein each of said link members includes a tab extending at an acute angle relative to its corresponding link member and joined at its base to said link member adjacent said projection, said tabs extending opposite one another and disposed in spaced parallel relation relative to each other when said link members are arranged in overlying relation relative to one another to channel ambient air through said passage.

17. An assembly as set forth in claim 16 wherein each of said tabs define a truncated triangular shape with a top edge and a pair of sides diverging from said top edge and terminating at said base of said tab adjacent said projection.

18. An assembly as set forth in claim 17 wherein said projection is rectangular in plan.

* * * * *